US005444882A

United States Patent [19]

Andrews et al.

[11] Patent Number: 5,444,882

[45] Date of Patent: Aug. 29, 1995

[54] SPINAL SURGERY TABLE

[75] Inventors: E. Trent Andrews, San Francisco; Robert R. Moore; Steven R. Lamb, both of Hayward, all of Calif.

[73] Assignee: Orthopedic Systems, Inc., Union City, Calif.

[21] Appl. No.: 225,348

[22] Filed: Apr. 8, 1994

Related U.S. Application Data

[63] Continuation of Ser. No. 62,079, May 14, 1993, abandoned, which is a continuation of Ser. No. 971,313, Nov. 4, 1992, abandoned, which is a continuation of Ser. No. 659,726, Feb. 25, 1991, abandoned, which is a continuation-in-part of Ser. No. 583,149, Sep. 17, 1990, abandoned.

[51] Int. Cl.[6] ..... A61G 7/00

[52] U.S. Cl. ..... 5/618; 5/624; 5/623; 601/24; 606/242; 606/245

[58] Field of Search ..... 606/240–245; 5/601, 613, 614, 618, 620, 624, 623; 108/131, 132; 601/24

[56] References Cited

U.S. PATENT DOCUMENTS

| | | | |
|---|---|---|---|
| 1,088,476 | 2/1914 | Stiles | 606/244 |
| 1,261,424 | 4/1918 | Miller | 606/245 |
| 1,568,968 | 1/1926 | Evins | 606/244 |
| 2,577,177 | 12/1951 | Anderson | 5/624 X |
| 3,281,141 | 10/1966 | Smiley et al. | 5/614 |
| 3,302,641 | 2/1967 | Berne et al. | 606/245 |
| 4,662,619 | 5/1987 | Ray et al. | 269/328 |
| 4,718,077 | 1/1988 | Moore et al. | 269/322 X |
| 5,297,539 | 3/1994 | Liebl et al. | 606/242 X |

FOREIGN PATENT DOCUMENTS

| | | | |
|---|---|---|---|
| 2100132 | 12/1982 | United Kingdom | 269/323 |

OTHER PUBLICATIONS

Technique Manual, Andrews Spinal Surgery Frame.
Andrews SST-3000 Spinal Surgery Table.
"Tables by Tower".
"Presenting Another Outstanding First" by the Tower Company.

*Primary Examiner*—Mary Beth O. Jones
*Attorney, Agent, or Firm*—Bielen, Peterson & Lampe

[57] ABSTRACT

A surgery table utilizing a frame member which is supported on a ground surface, A platform is connected to the frame member and includes a laterally movable portion which supports a patient. The table also includes a torso support which is connected to and moves with the laterally movable portion of the platform. A leg support rotates relative to the platform and connects to a hip support which holds the patient's hip during such rotation.

15 Claims, 11 Drawing Sheets

SPINAL SURGERY TABLE

CROSS REFERENCES TO RELATED APPLICATIONS

The present application is a continuation of Ser. No. 08/062,079, filed May 14, 1993, now abandoned which is a continuation of Ser. No. 07/971,313, filed Nov. 4, 1992,now abandoned, which is a continuation of Ser. No. 07/659,726, filed Feb. 25, 1991, now abandoned, which is a continuation-in-part of Ser. No. 07/583,149, filed Sep. 17, 1990,now abandoned.

BACKGROUND OF THE INVENTION

The present invention relates to a novel and useful surgery table which is especially useful for positioning a patient for spinal surgery.

A standard surgery table is generally unsatisfactory for the performance of spinal surgery procedures such as lumbar laminectomies, decompressions and fusions. To perform such techniques, a patient is best positioned in the prone sitting position. In addition, radiographic images are usually taken with the patient in the prone kneeling position, which is especially critical for pedicle screw fixations.

In the past, the Andrews spinal surgery frame has been employed as an accessory to standard operating tables in order to properly position a patient for spinal surgery. Although the Andrews frame has been the standard spinal surgery accessory, is often difficult to adapt the Andrews frame to the variety of standard surgery tables. In addition, it often requires several persons to position the patient on the Andrews frame, especially into the prone sitting position. Moreover, radiological images are not easily obtained with the Andrews frame and a standard spinal surgery table.

U.S. Pat. No. 4,662,619 describes an improved kneeling attachment to the Andrews frame. U.S. Pat. No. 4,718,077 describes a radiolucent table which is useful with a C-arm fluoroscope. The spinal surgery table designated the SST-3000 manufactured by Orthopedic Systems, Inc. partially integrates the features of the Andrews frame and a standard surgery table although still requiring multiple persons to manipulate the patient into an operative position.

A surgery table which overcomes the disadvantages of the prior spinal surgery frames would be a great advance in the medical field.

SUMMARY OF THE INVENTION

In accordance with the present invention a novel and useful spinal surgery table is herein provided.

The spinal surgery table of the present invention utilizes a frame member which includes means for supporting the frame member on a ground surface. Frame member may include a first section extending laterally relative to the platform and a second section also extending laterally relative to the platform. A member connects a first and second sections and is offset from the centers from the first and second sections. The connecting member may be positioned at a lower level than portions of the first and second sections. Such offset and lowered connecting member is especially useful in permitting employment of a C-arm X-ray imager with the patient in either the prone kneeling, or prone sitting position. Casters may be attached to the frame to permit rolling of the frame on the ground surface.

The frame member connects to a platform which supports the patient undergoing surgery. Such platform may be disposed at the terminus of a pedestal which is vertically movable to determine the height of a platform above the ground surface. In addition to the lateral tilt Trendelenberg, and leg position adjustments, the table of the present invention provides for the patient supporting platform having a laterally movable portion. Such laterally movable portion may ride along an axis of the spinal surgery table. An arm support may also be found in the present invention and is connected to the laterally movable portion of the platform for concomitant motion. In addition, the arm support may rotate inwardly and outwardly relative to the platform. The surgery table is also constructed with a torso support which externalizes in a carriage supported by the platform and is connected to the laterally movable portion thereof. The torso support further possesses a torso lift mechanism for raising and lowering the torso of the patient relative to the platform. In this regard, a hydraulic mechanism utilizing a hydraulic cylinder travels laterally with the carriage of the torso support mechanism and, thus, with the laterally movable portion of the platform.

The surgery table of the present invention further employs a leg support which is found in articulated relationship with the platform. The leg support has as one of its elements a tibial support and means for vertically adjusting the tibial support relative to the platform. Also, the leg support includes means for rotating the leg support relative to the platform which essentially serves as a foot end adjustment. The leg support rotating means is motivated with a hydraulic mechanism. The torso lift hydraulic mechanism and the leg support hydraulic mechanism may share a reservoir of hydraulic fluid and be controllable through valve means found on a manifold. In addition, the other surgery table movement operations such as the table height, Trendelenberg, lateral tilt, and the like may be controlled through individual valves on such manifold and also share the hydraulic fluid reservoir.

It may be apparent that a novel and useful surgery table has been described.

It is therefore an object of the present invention to provide a surgery table which permits one person, after patient transfer onto the table, to place the patient into the operative position for spinal surgery without assistance from other persons.

It is another object of the present invention to provide a surgery table which permits the surgeon performing spinal surgery to control the patient's lumbar spine to varying degrees of flexion extension.

It is another object of the present invention to provide a spinal surgery table which positions the patient such that the abdomen hangs freely, in a completely dependent position to eliminate vena caval compression and, consequently, epidural venus bleeding.

It is yet another object of the present invention to provide a spinal surgery table which permits the obtaining of C-arm or conventional x-ray images with a patient positioned in either the knee chest or prone position.

A further object of the present invention is to provide a spinal surgery table which includes a torso lift mechanism to support and reposition a patient as the foot end of the spinal surgery table is lowered to the 90 degree position.

Another object of the present invention is to provide a spinal surgery table which includes easily accessible and simplified controls used to positioned the patient for spinal surgery.

Yet another object of the present invention is to provide a spinal surgery table which maintains excellent stability during surgical maneuvers.

Another object of the present invention is to provide a spinal surgery table including an independently movable leg support which links to a hip support for synchronous movement therewith.

A further object of the present invention is to provide a spinal surgery table which is convertable for use as a conventional surgery table.

The invention possesses other objects and advantages especially as concerns particular characteristics and features thereof which will become apparent as the specification continues.

Figure 6:
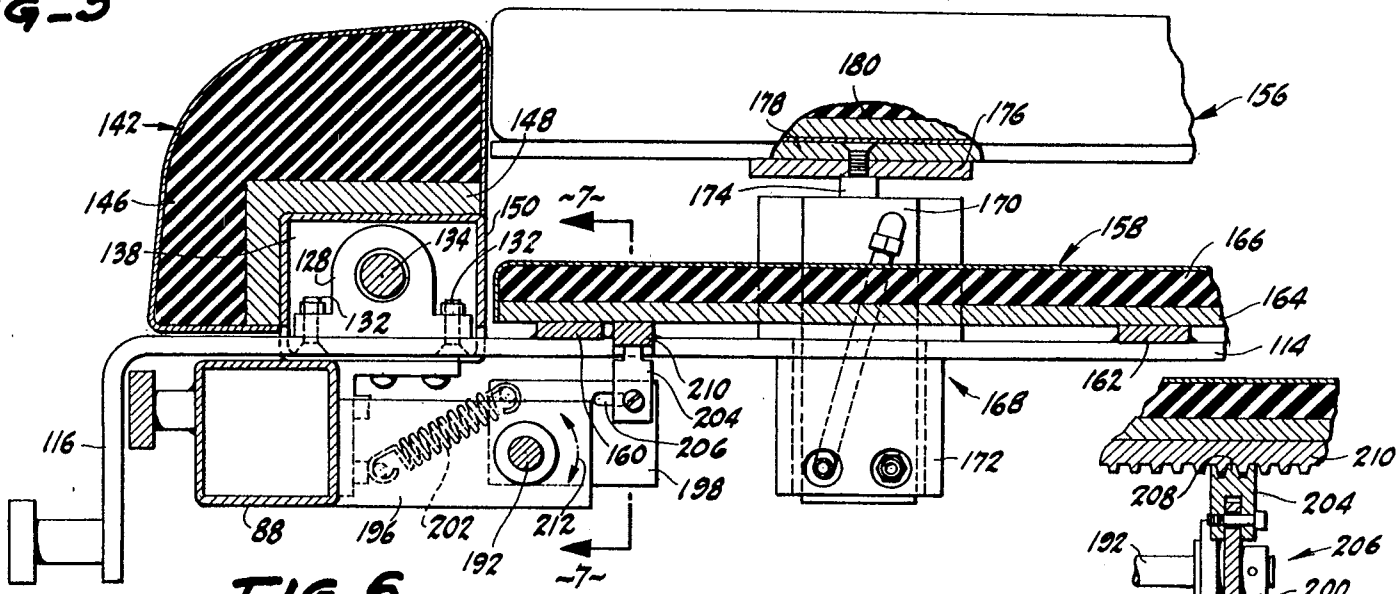
FIG. 6 is an enlarged sectional view of the upper left hand portion of FIG. 4 depicting the slide and locking mechanism of the movable portion of the platform of the present invention.

FIG, 7 is a sectional view taken along line 7—7 of FIG. 6.

Figure 4:
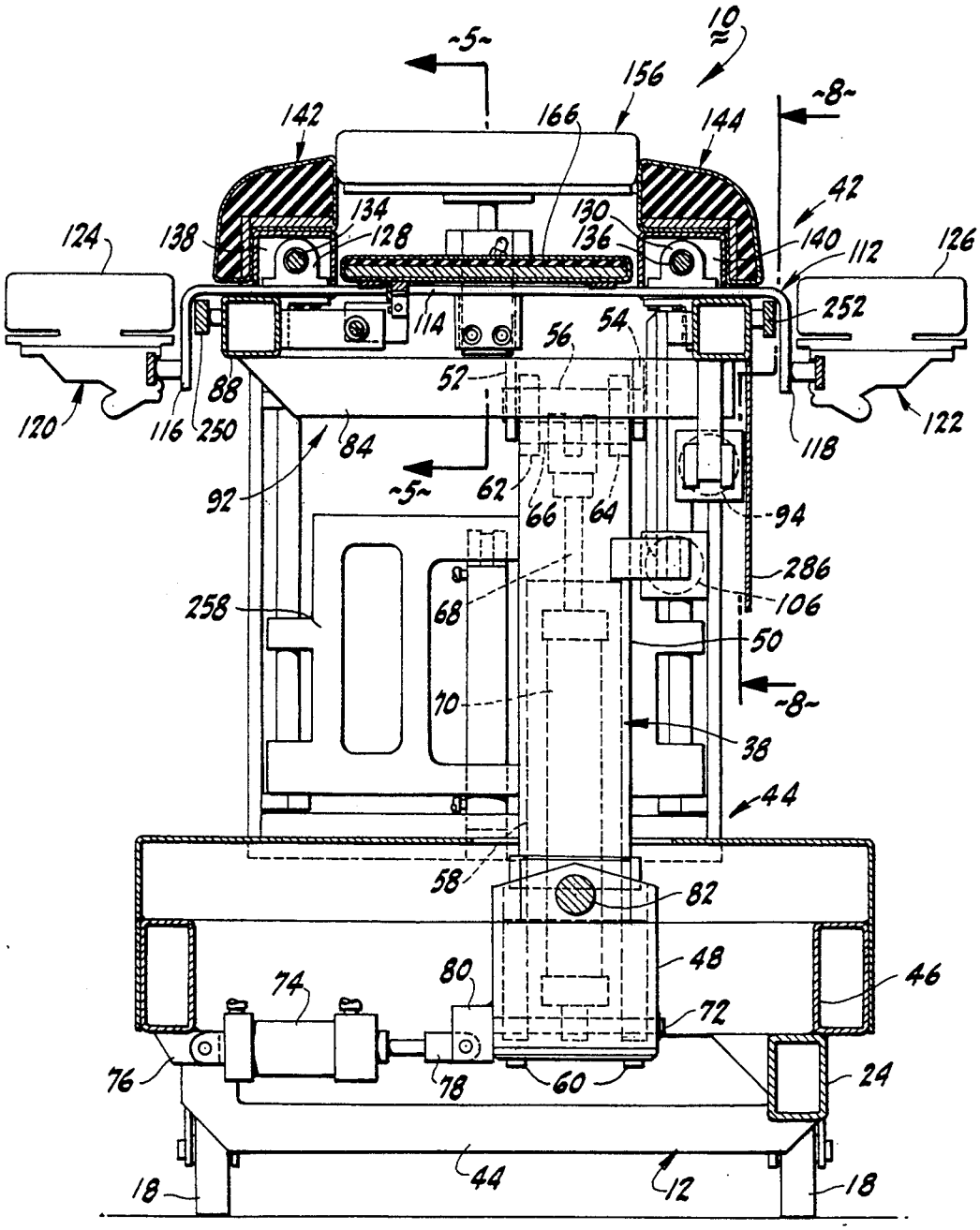
FIG. 4 is a view taken along line 4—4 of FIG. 1.
Figure 8:
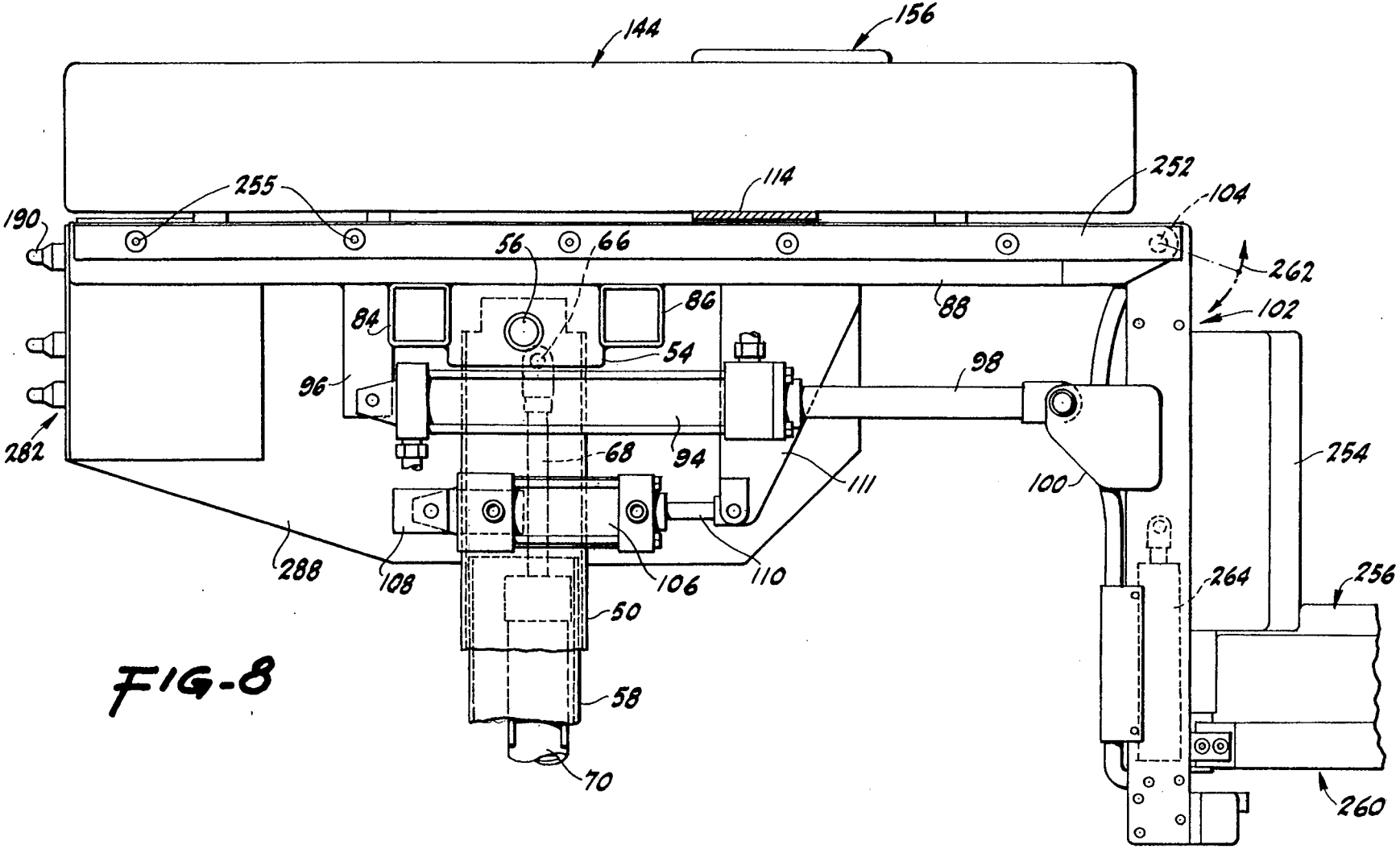

FIG. 8 is a sectional view taken along line 8—8 of FIG. 4.

Figure 1:
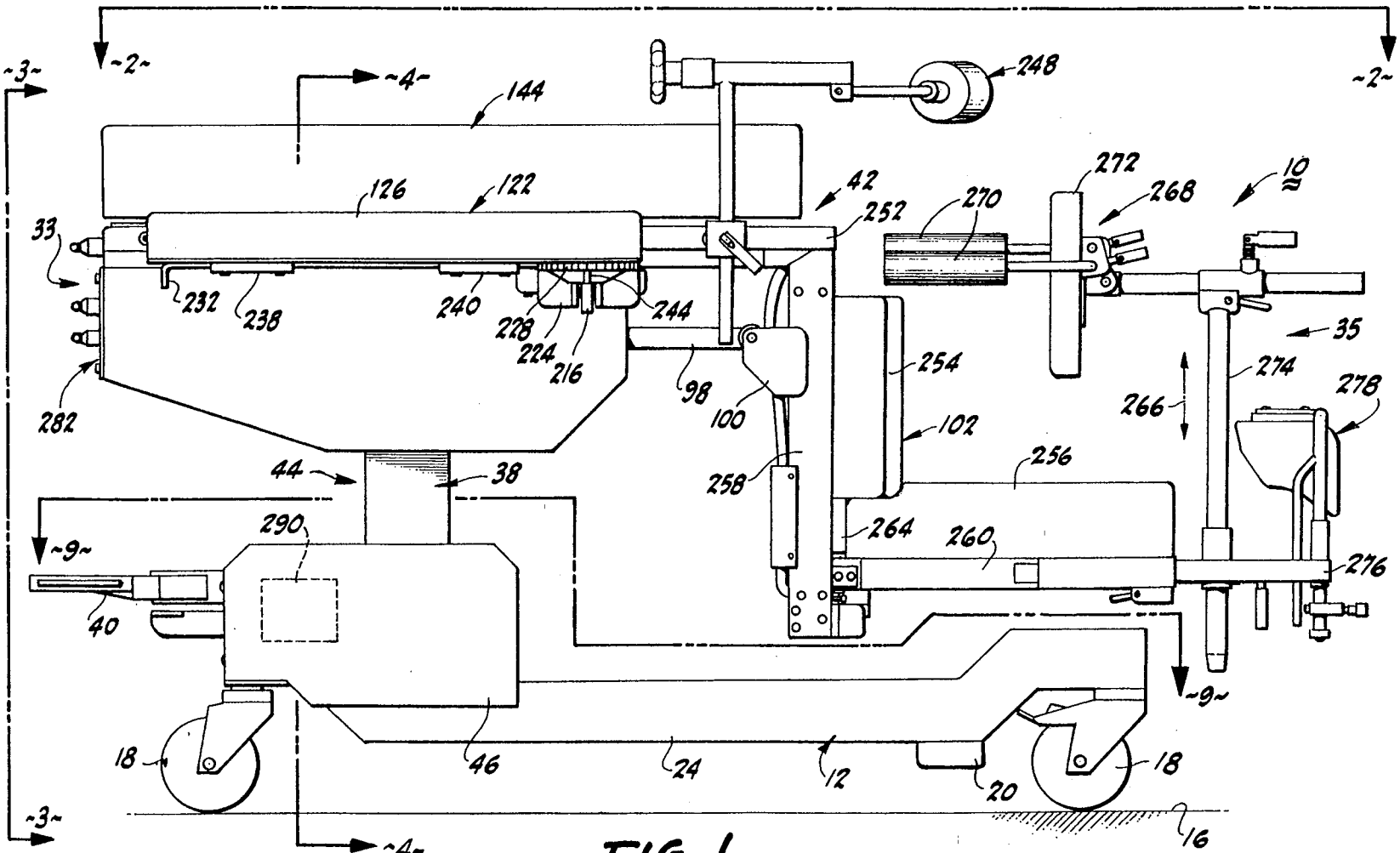
FIG. 1 is a side elevational view of the surgery table of the present invention.
Figure 9:
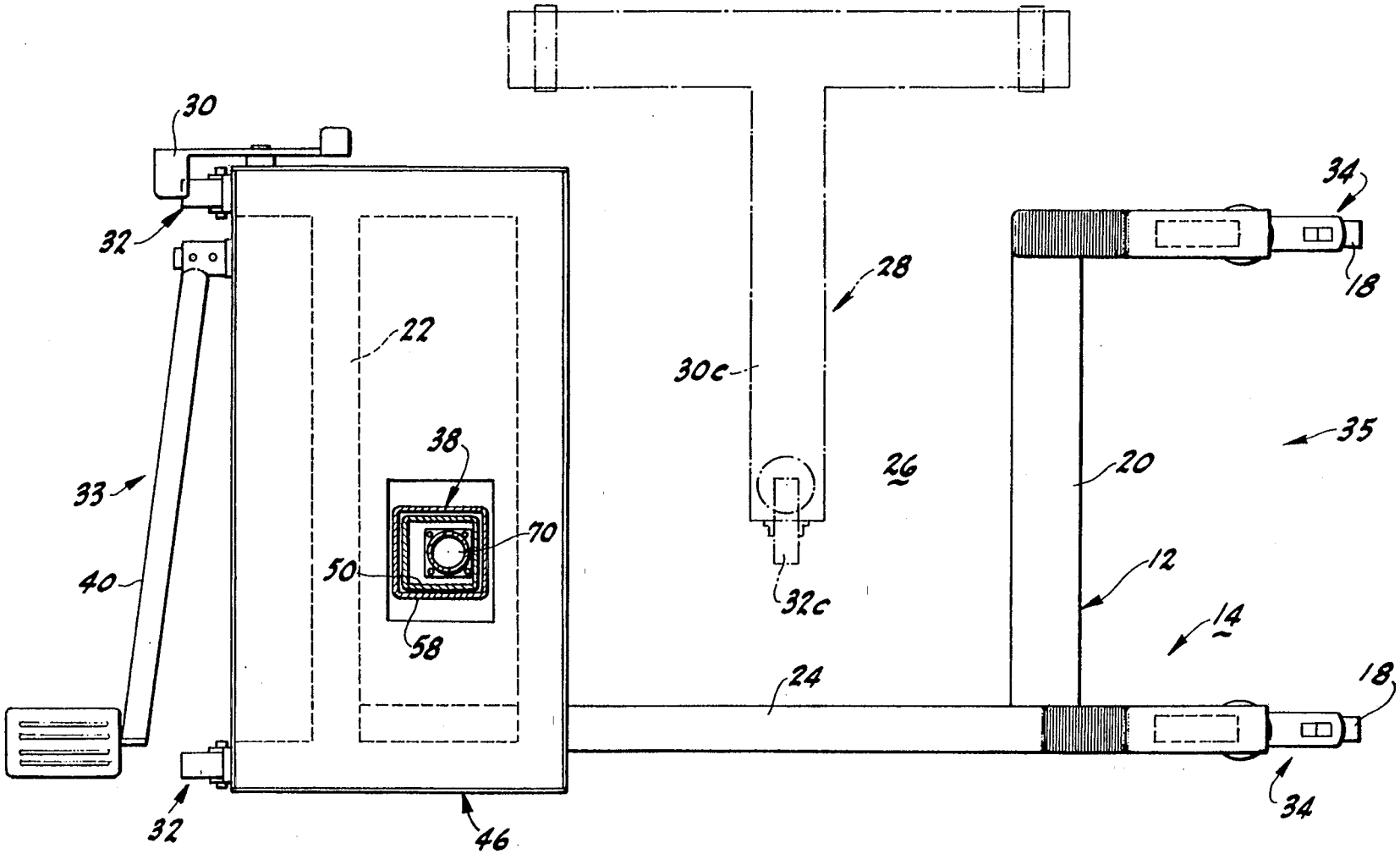

FIG. 9 is a sectional view taken along line 9—9 of FIG. 1.

Figure 10:
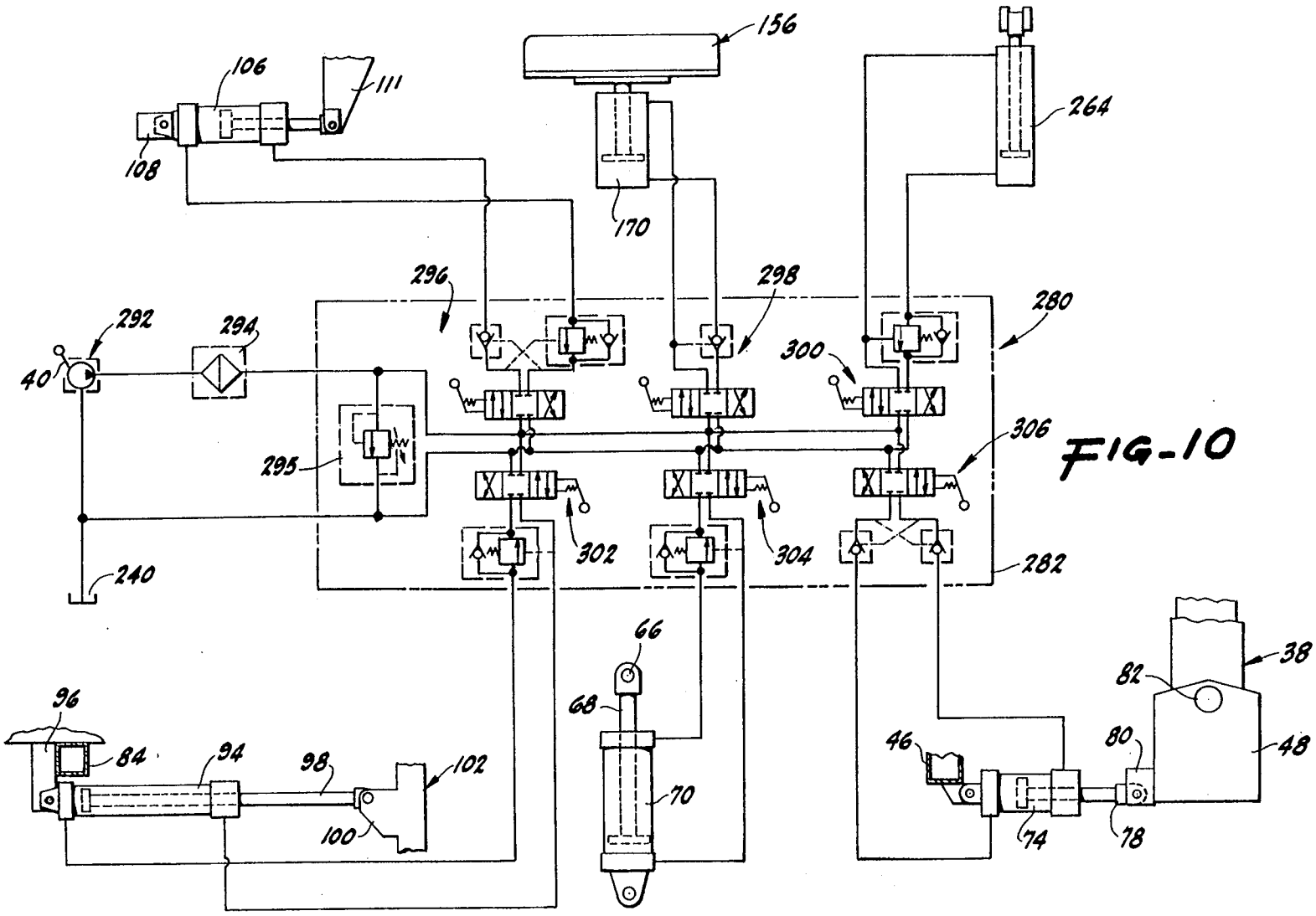

FIG. 10 is a schematic-pictorial view of the hydraulic system of the present invention.

Figure 11C:
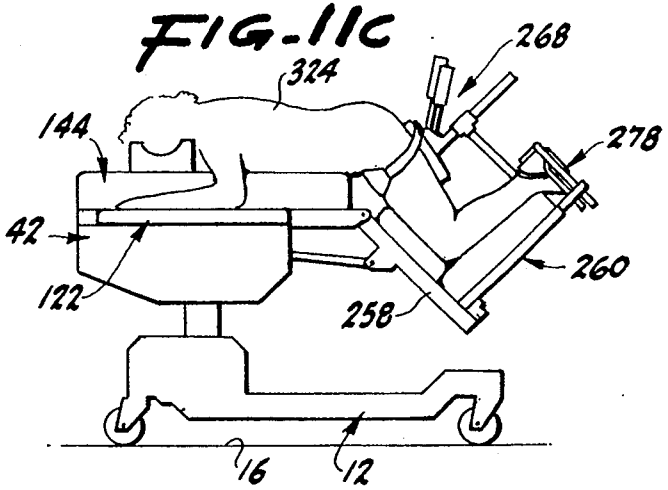
Figure 11A:
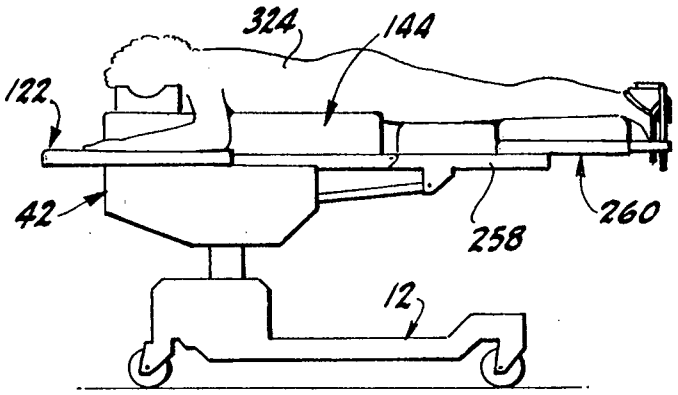

FIG. 11A is a pictorial view of the first of a sequential positioning of a patient for spinal surgery.

Figure 11D:
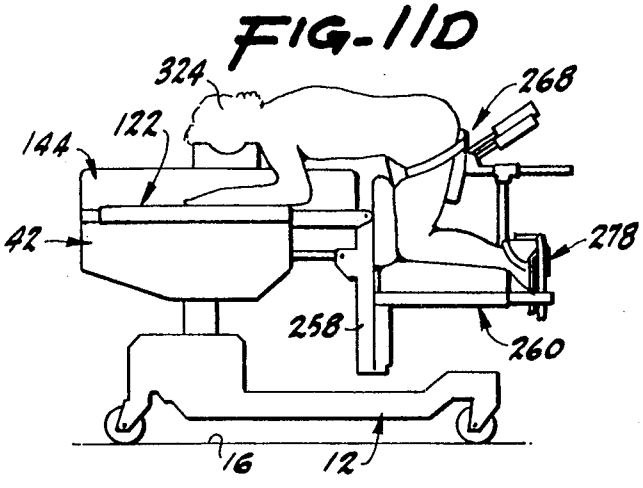
Figure 11B:
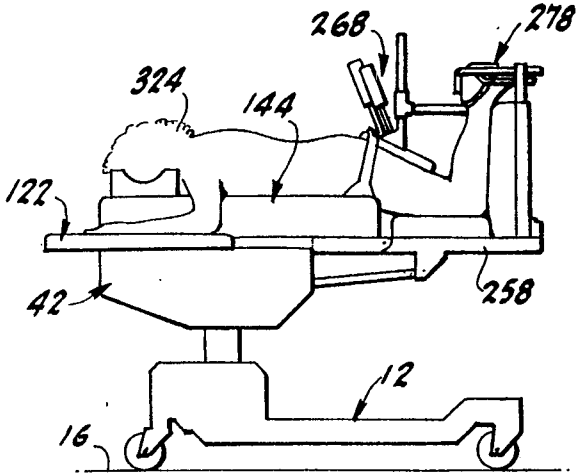

FIG. 11B is a pictorial view of the second of a sequential positioning of a patient for spinal surgery.

FIG. 11C is a pictorial view of the third of a sequential positioning of a patient for spinal surgery.

FIG. 11D is a pictorial view of the fourth of a sequential positioning of a patient for spinal surgery.

Figure 12:
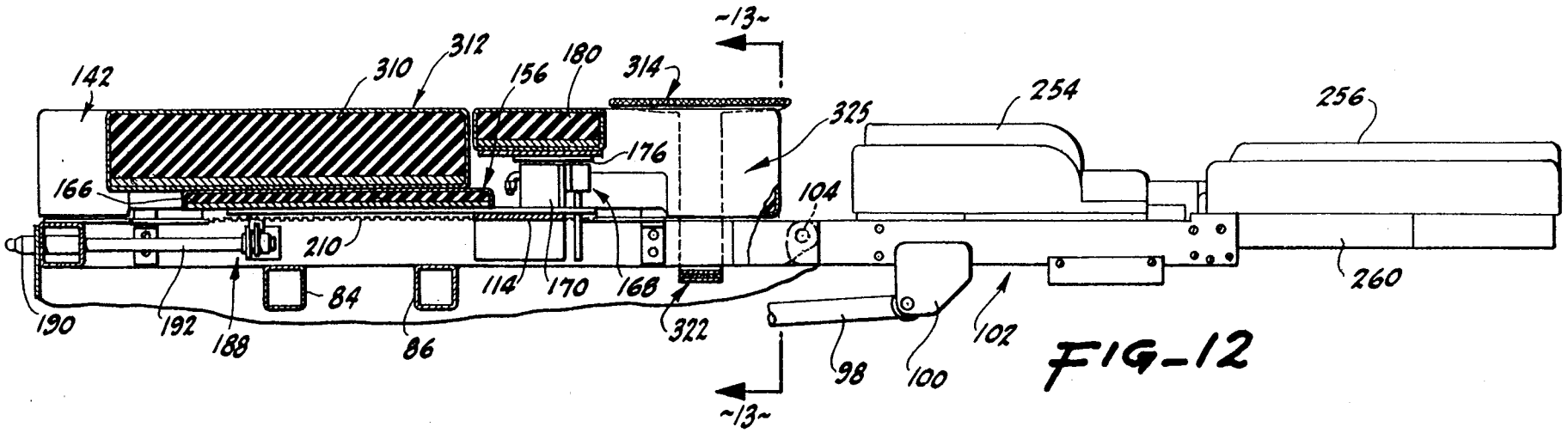

FIG. 12 is a side elevational view of the upper elements of the surgery table including a flat platform on the upper surface.

Figure 13:
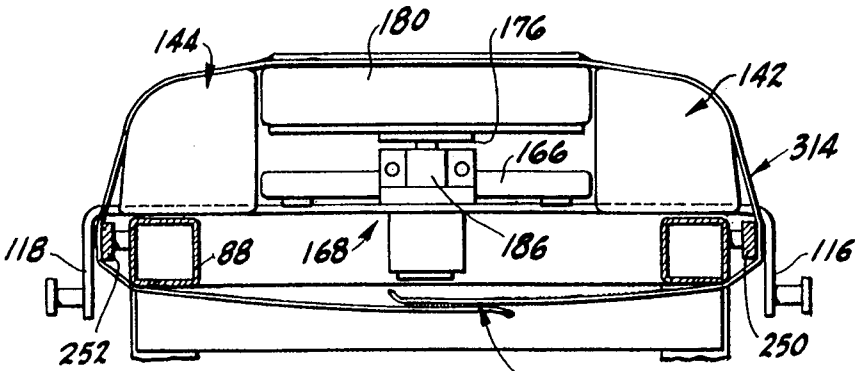

FIG. 13 is a sectional view taken along line 13—13 of FIG. 12.

Figure 14:
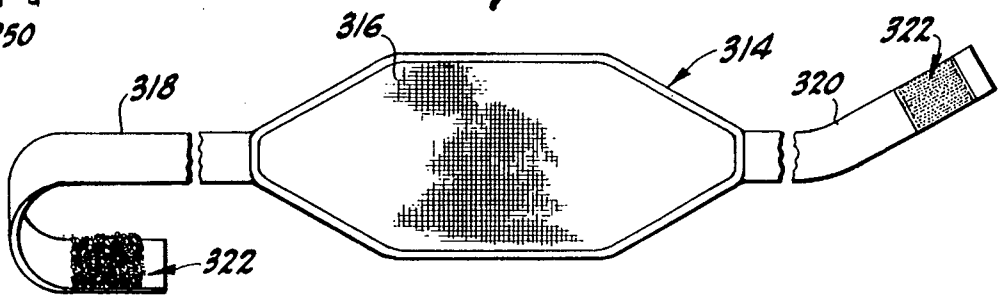

FIG. 14 is a top plan view of a hip sling with broken portions.

Figure 15:
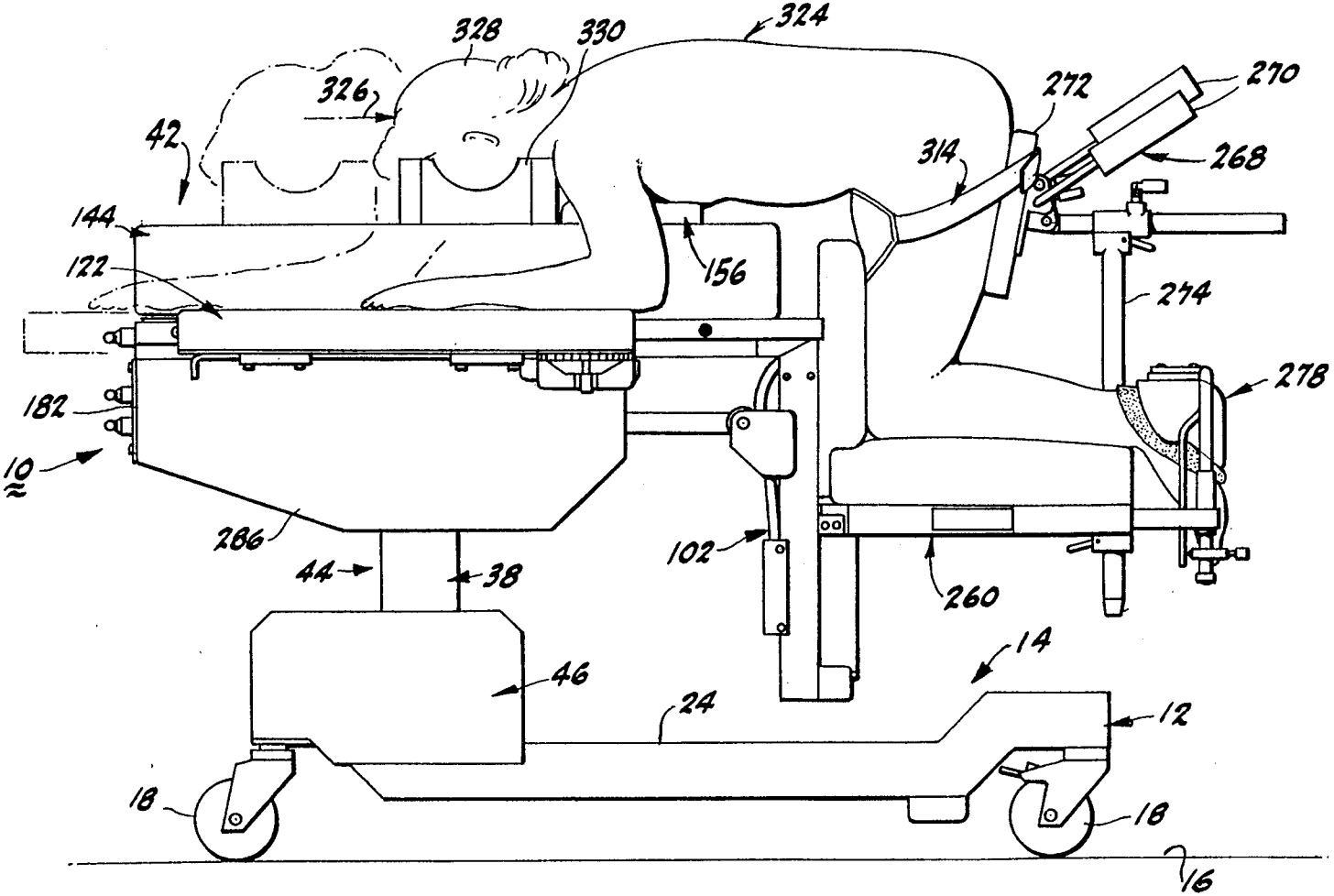

FIG. 15 is a side elevational view of the spinal surgery table of the present invention depicting a patient being moved from a prone position to a kneeling prone position including the use of the hip sling of FIG. 14.

For a better understanding of the invention reference is made to the following detail description of the preferred embodiments thereof which should be referenced to the hereinabove described drawings.

DESCRIPTION OF THE PREFERRED EMBODIMENTS

Various aspects of the present invention will evolve in the following detailed description of the preferred embodiments thereof which should be referenced to the hereinabove described drawings.

The invention as a whole is shown in the drawings by reference character 10. The surgery table 10 is especially useful for spinal surgery positioning of a patient. Table 10 includes as one of its elements a frame member 12 which includes means 14 for supporting frame member 12 on surface 16. Means 16 is shown in the form of a quartet of casters. Frame member 12 also includes a first section 20 and a second section 22 which extend laterally relative to surface 16, FIG. 9. Connecting member 24 extends between first and second sections 20 and 22 to form a cavity 26 or recess in frame member 12 which permits the use of C-arm 28 employed to obtain radiographic images of a patient on table 10. Thus, connecting member 24 is offset from the centers of first and second sections 20 and 22 and lies at a lower level. In this regard, C-arm 28 includes a support member 30 having a caster 32 which easily rolls into cavity 28 to obtain geographic images. Plurality of casters 18 may include locking mechanisms such as wheel lock 30. Plurality of casters 18 include a pair of casters 32 at the head end 33 of spinal surgery table 10, and a pair of casters 34 at the foot end 35 of table 10. Pair of casters 32 may be of the type number 2476 UAR available from the American Tente Casters Inc. of Erlanger, N.Y. Pair of casters 34 may be of the type 2477 UAR also available from American Tente Casters, Inc., of Erlanger, N.Y. Pedestal 38 extends from frame member 12 upwardly, the details of which will be described hereinafter. Also, foot pedal 40 forms part of a hydraulic system which will also be described in detail hereinafter.

Returning to FIG. 1, table 10 also includes platform 42 for supporting a spinal surgery patient. Platform 42 is connected to frame member 12 by means 44, shown in particular on FIG. 4. Box support 46 is welded to frame section 22 and connecting member 24. Mounting member 48 gains support from frame member 12 and holds fixed telescoping tube 50 in an upright position. Telescoping tube 50 extends upwardly and is fastened to frame plates 52 and 54 by the use of a pivot pin 56, FIGS. 4 and 8. It should be noted that pivot pin 56 acts as the axis for the Trendelenberg motion of platform 42 relative to frame 12, which will be discussed hereinafter. Fixed tube 58 extends downwardly into mounting member 48 and is fastened to same with fasteners 60. Fixed tube 58 serves as a guide for telescoping tube 50. Ears 62 and 64 engage pin 56 and also serve as the support for connecting pin 66 of piston yoke 68 extending from table height hydraulic cylinder 70. Fastening pin 72 at the base of table height hydraulic cylinder 70 bolts to mounting member 48.

Again with reference to FIG. 4, table lateral tilt hydraulic cylinder 74 connects to flange 76 which is fixed to box support 46. Piston yoke 78 of lateral tilt hydraulic cylinder 74 fastens to wing member 80 which is rigidly attached to mounting member 48. Lateral tilt pivot pin 82 permits mounting member 48, pedestal 38, and platform 42 to effect such lateral tilt of table 10. With further reference to FIGS. 4 and 8, it may be observed that frames 52 and 54 depend from cross-members 84 and 86 which are welded or otherwise fastened to rectangular member 88 of platform 42, cross-members 84 and 86, and rectangular member 88 comprise a skeletal base portion 92 of platform 42.

With further reference to FIG. 8, foot end hydraulic cylinder 94 fixes to plate 96 which depends from base portion 92. Piston yoke 98 of foot end hydraulic cylinder 94 fastens to plate 100 which is itself fastened to articulated section 102 of base portion 92 of platform 42. Articulated section 102 of platform 42 pivots around pivot pin 104, FIGS. 5 and 8. Again referring to FIG. 8, Trendelenberg hydraulic cylinder 106 fastens to block 108 which structurally connects to base portion 92 of platform 42. Piston yoke 110 fastens to angle member 111 which depends from base portion 92. Again, pivot pin 56 serves as the pivot axis for the Trendelenberg rotation of platform 42.

Figure 5:
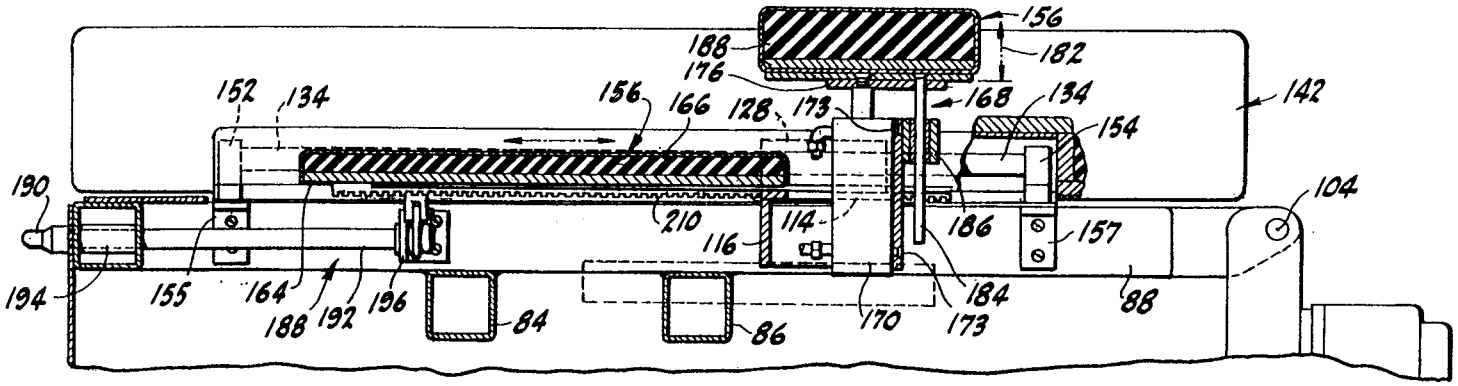
FIG. 5 is a view taken along line 5—5 of FIG. 4.
Figure 7:
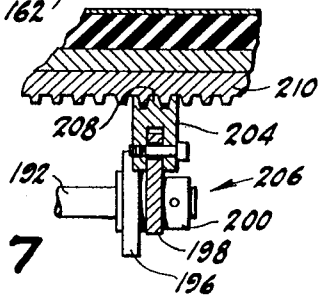

Referring now to FIG. 4, it may be apparent that platform 42 includes a transversely movable portion 112. As shown in FIG. 4, as well as FIGS. 11A–11D which will be discussed in greater detail hereinafter, the term "transversely" is defined as that which coincides with the length of table 10. Plate 114 forms a part of transversely movable portion 112 and includes distending end portions 116 and 118 which connect to arm supports 120 and 122. Thus, arm supports 120 and 122 move with plate 114. Arm supports 120 and 122 include pads 124 and 126. Journals 128 and 130 connect to plate 114 with fasteners 132, FIG. 7. Journals 128 and 130 slide along rods 134 and 136 within tunnels 138 and 140 formed by longitudinal pad members 142 and 144. With reference to FIG. 7, it may be observed that longitudinal pad member 142, is similarly constructed to longitudinal pad member 144. Pad member 142 is formed by a soft covered pad 146 which lies atop a rigid L-shaped bottom 148. Bottom 148 lies atop a U-shaped channel 150. Turning to FIG. 5, rod 134 held to end pieces 152 and 154, is fastened to rectangular member 88 via brackets 155 and 157, respectively.

Turning to FIGS. 4, 5, and 6, table 10 also includes a torso support 156 which possesses a carriage 158 which is welded to plate 114 by the use of strips 160 and 162. Face pad base 164 connects to strip 162 and also supports a soft covered pad 166, best shown in FIGS. 5 and 6.

Torso support 156 also includes a torso lift mechanism 168 which possesses a torso lift hydraulic cylinder 170, FIGS. 5 and 7. Support bracket 172 connects to movable plate 114 and also serves as a support for torso lift hydraulic cylinder 170 via fasteners 173, FIG. 5. Thus, the torso lift hydraulic cylinder 170 travels laterally with the movable plate 114. Piston 174 of torso lift hydraulic cylinder 170 extends through a rigid sheet 176 which fastens to the base 178 of covered torso pad member 180. With reference to FIG. 5, it may be apparent that covered torso pad member 180 travels along directional arrow 182. For a pad support shaft 184 also connects to rigid sheet 176 and base 178 of pad 180. Bearing 186 guides the movement of torso pad support shaft 184.

Again referring to FIGS. 5, 6 and 7, torso support 156 includes a locking mechanism 188 formed with a handle 190 at the terminus of rod 192. Bushing 194 supports rod 192 through structural member 88. Bracket 196 holds the end of rod 192, opposite handle 190, to structural member 88. Plate 198 surrounding bushing 200 rotates about rod 192 and is biased in the position shown in FIG. 6 by spring member 202 which spans bracket 196 and rotating plate 198. Finger 204 extends from rotating plate 198 and is adjustable by slot mechanism 206. Teeth 208 on the end of finger 204 engage the teeth on track 210 which is formed on movable plate 114, FIG. 7. Turning rod 192 clockwise, directional arrow 212, disengages locking mechanism 188 and movable plate 114 to permit sliding of movable portion 112 of platform 42. Conversely, counterclockwise motion of rod 192 locks movable portion 112 of platform 42 in place.

As heretofore described, arm supports 120 and 122 are connected to transversely movable portion 114. With reference to FIG. 3, it may be observed that tabs 214 and 216 may be pushed inwardly to disengage arm supports 120 and 122 from tracks 218 and 220 by the use of pivoting latches 222 and 224. In addition, arm supports 120 and 122 include gear wheels 226 and 228. Turning to FIGS. 1 and 3, pull rods 230 and 232 are slidingly fastened to structural elements 234 and 236 of arm supports 120 and 122, respectfully. Such slidable fastening may include a pair of sleeves, such as sleeves 238 and 240 with respect to arm support 122, which are screwed to structural element 236 used in conjunction with pull rod 232, FIG. 1. In essence, the disengagement of the end of pull rods 230 and 232 from gear wheel 226 and 228, respectively, permits arm supports 120 and 122 to pivot around pivot pins 242 and 244, depicted in phantom on FIG. 2.

Figure 2:
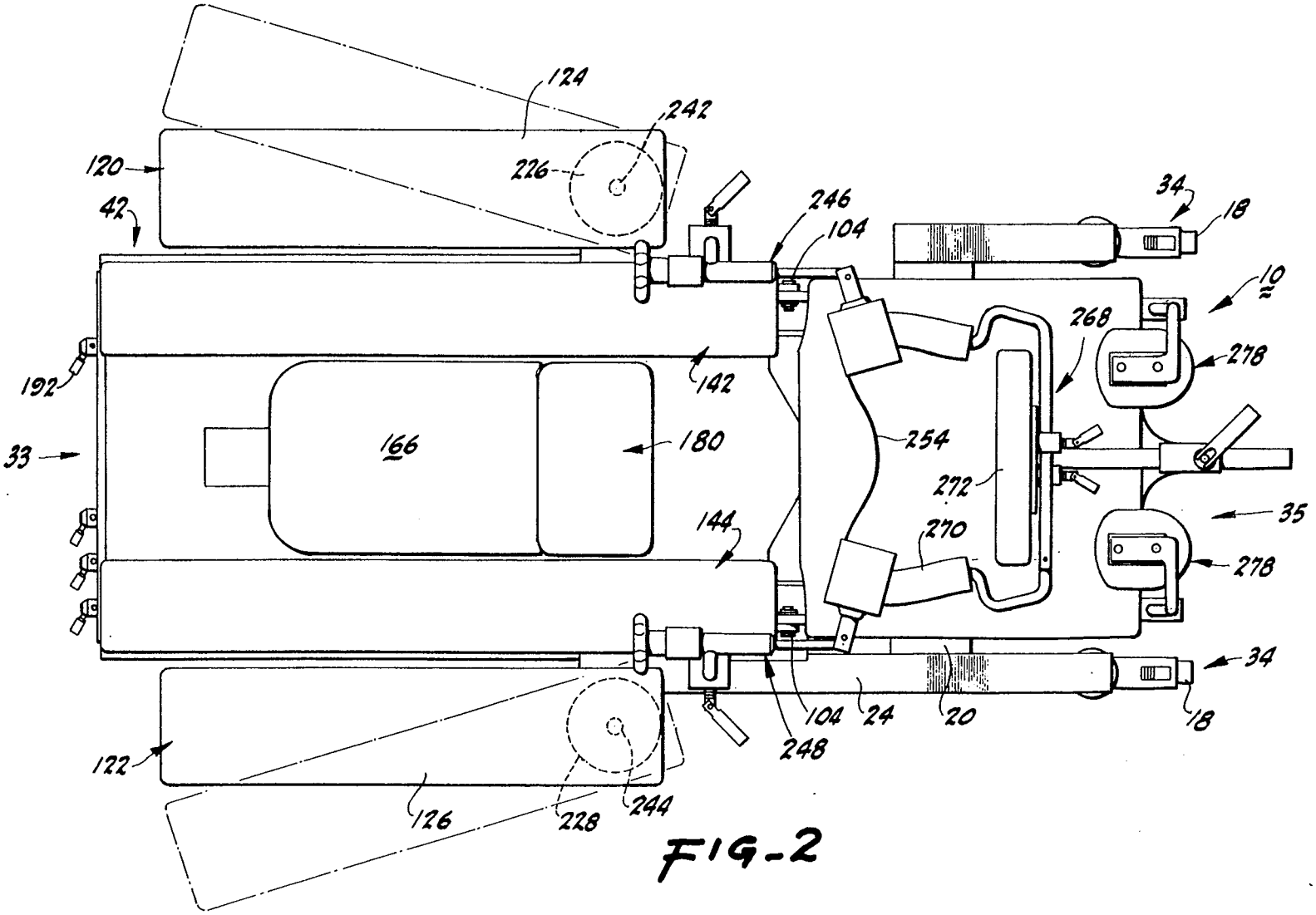
FIG. 2 is a top plan view of the surgery table of the present invention.
Figure 3:
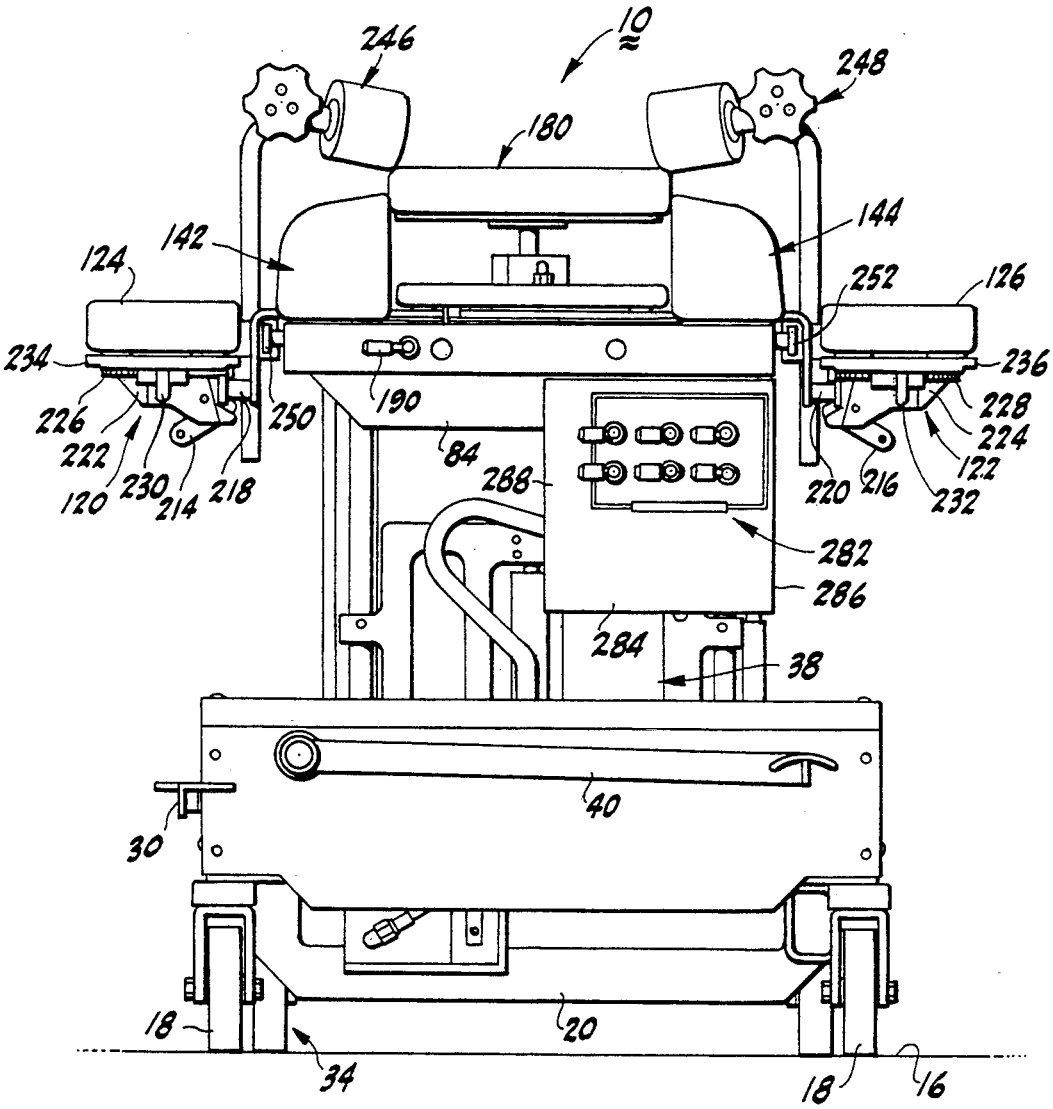
FIG. 3 is a left end view of the surgery table of the present invention.

Turning to FIGS. 1 and 2, spinal surgery table 10 also includes the provision of iliac supports 246 and 248 which are fastened to tracks 250 and 252 connected to rectangular frame member 88 by plurality of fasteners 254, FIG. 8. Iliac supports 246 and 248 may be of the type found in the Andrews SST 3000 Spinal Surgery Table manufactured by Orthopedic Systems, Inc., San Leandro, Calif. Supports 246 and 248 are optionally used by surgeon to level the lumbar spine when the patient is in the prone kneeling position on table 10.

Articulated section 102 of platform 42 includes soft pad members 254 and 256 which are attached to rotating arm 258 and movable support 260, FIG. 8. Rotating arm 258 is rotatably connected to movable support 260. Plate 100 fixed to rotating arm 258 permits the rotation thereof around pivot 104, through the motion of foot end hydraulic cylinder 94, directional arrow 262. Soft pad 256 is intended to support the tibia of the patient. Tibial support hydraulic cylinder 264, FIGS. 1 and 8, interconnects rotating arm 258 and movable support 260, such that soft pad 256, and the patient's tibia supported thereon may be raised or lowered along directional arrow 266, FIG. 1. Seat and thigh support mechanism 268, of conventional configuration, includes thigh support pads 270 and seat support 272. Post 274 connects to movable support 260 which has an extendable end portion 276. Foot cuff mechanism 278 captures the heels of the patients legs.

Turning to FIGS. 1 and 10, it may be observed that table 10 includes a hydraulic system 280. FIG. 10 is a schematic and partial mechanical rendition of hydraulic system 280 in which hydraulic cylinders heretofore described have been partially depicted. Control panel 282, FIG. 3, is depicted as being mounted on a plate 284 with side portions 286 and 288. System 280 includes a common reservoir of hydraulic fluid 290 depicted schematically within box support 46. Pump 292 may of the type 100212, manufactured by TR Engineering Inc., of Campbell Calif. As heretofore described, pump 292 is operated by foot pedal 40. Filter 294 and overload valve 295 regulates the hydraulic fluid passing to three way valves 296, 298, 300, 302, 304, and 306. In other words, valve 296 regulates the Trendelenberg movement of table 10. Trendelenberg, control valve 296 would possess the ability to adjust the table in the Trendelenberg position, reverse Trendelenberg position, or be in the "off" position. Also torso lift valve 300, tibial support valve 280, foot end valve 302, and table height valve 304 would operate to move the particular hydraulic cylinders "up" "down" or "off". Lateral tilt valve 306 operates between the "left", "right", or "off" position. The following is a table depicting components used in the hydraulic system 280.

| Component | Model # | Source |
|---|---|---|
| 1. Trendelenberg cylinder 106 | H2050225BN8FOO | Lehigh Fluid Power Inc. Lambertville,N.J |
| 2. Torso lift cylinder 170 | Husky BFH/3/8 × 3.0 | Compact Air Prod. Westminster,S.C. |
| 3. Tibial support cylinder 269 | Husky QJ90-1122 | Compact Air Prod. Westminster,S.C. |
| 4. Foot End cylinder 94 | H2010825BN8F8 | Lehigh Fluid Power Inc. Lambertville,N.J. |
| 5. Table Height Cylinder 70 | 2-AO-NPIN-33 -S-1500 | Cunningham Manuf. Co., Seattle,WA. |
| 6. Lateral Tilt Cylinder 24 | H2050188DN8FOO | Lehigh Fluid Power Inc. Lambertville,N.J. |

With reference to FIGS. 12 and 13, it may be observed that the upper portion of platform 42 may be converted into a conventional surgery table by the use of a covered pad 310 which sits atop pad 166. Torso lift mechanism 168 would be raised to the point depicted in FIG. 12 such that pad 180 lies essentially flush with the top surface 312 of pad 310. With reference to FIG. 14, it may be observed that a sling 314 is depicted as having a widened central portion 316 and connecting bands 318 and 320. Hook and pile closure means 322 permits sling 314 to be formed into a loop, as depicted on FIGS. 12 and 13, which provides support for the patient above radiolucent area 325.

Turning now to FIG. 15, patient 324 is shown in a position between the kneeling-prone and sitting-prone configuration. Patient 324 has been moved along directional arrow 326. The head portion 328 of patient 324 lies in a soft support 330. Sling 314 has been placed around the hip portion of patient 324 and is also wrapped about seat support 272 of the terminous of seat and thigh support 268. Thigh pads 270 have been rotated rearwardly so as to not interfere with the sling 314.

In operation, table 10 is arranged such that platform 42 and articulated section 102, thereof, essentially lie in the same plane, FIG. 11A. The patient is placed on platform 42 such that the patient's torso lies on covered torso pad member 180 and the face portion lies on covered face pad 166. Arm supports 120 and 122 typically move forward such that the patient's arms extend outwardly from the patient's torso at about ninety degrees and downwardly. Movable support 260 is rotated ninety degrees relative to rotating arm 258 to bend the patient's leg at the knee joint, FIG. 11B. Seat support mechanism 268 and foot cuffs 278 are attached at this time. Locking mechanism 188 is released to permit torso support 156 and arm supports 120 and 122 to slide laterally with transversely movable portion 112 toward the foot end of table 10, FIG. 11C when the rotating arm 258 pivots relative to torso support 156 on pivot 104. Sling 314 aids in the lifting of the patient 324, FIG. 15, to prevent extension of patient 324 into radiolucent opening 325 and to prevent the hyperextension of the lumbar spine of patient 324. Sling 314 acts synchronously with the gliding of the torso lift mechanism 156, and the articulation of section 102. At this point, the patient is in the kneeling prone position to permit the surgeon or anesthesiologist to control the flexion or extension of the lumbar spine by varying degrees. Further movement of foot end cylinder 94 via operation of valve 302, and the upward movement of tibial support cylinder 264 by operating valve 300 places the patient in the prone sitting position FIG. 11D. Again, the locking mechanism 188 of the torso support 156 would be released and subsequently locked into position to prevent further movement in this regard. The table height cylinder 70 employing valve 304, Trendelenberg cylinder 106 using valve 296, or lateral tilt cylinder 74 using valve 306 may be activated to achieve the correct positioning of the patient according to the intended operative procedure. Most importantly, the torso lift cylinder 170, employing valve 298 may also be employed to elevate the patient to provide for the correct positioning of head/neck and arms/shoulders of the patient. Iliac crest supports 248 and 250 may be optionally be applied when the patient is in the kneeling prone position, FIG. 11C, in order to level the lumbar spine. Frame member 12 permits C-arm imager 28 to easily obtain radiographic images of the patient in the prone or kneeling prone positions. It should be noted that connecting member 24 lies at a lower level than portions of lateral members 20 or 22 to prevent any interference with the movable C-arm 28.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A patient surgery table comprising:

a. a frame member, said frame member including means for supporting said frame member on a surface;

b. a platform for supporting the patient, said platform including a transversely movable portion;

c. joining means for connecting said platform to said frame member;

d. a torso support, for directly supporting the torso of the patient, said torso support including a carriage supported by said platform, said torso support being connected to and movable with said transversely movable portion of said platform;

e. a leg support, said leg support being in articulated relationship with said platform and including means for pivoting said leg support relative to said platform;

f. means for linking the hip portion of the patient to said rotatable leg support, such that a pulling force is exerted on the hip portion of the patient during said rotation of said leg support and g. an arm support, said arm support being movable transversely with said transverse movement of said torso support; said torso support and said arm support being connected to said means for pivoting said leg support, such that said transverse movements of said torso support and said arm support are achieved with said pivoting of said leg support.

2. The patient surgery table of claim 1 in which said means for linking the hip portion of the patient to said pivoting leg support includes a hip sling and a post extending outwardly from said pivoting leg support.

3. The patient surgery table of claim 2 which additionally includes a buttocks support and means for adjustably connecting said buttocks support to said post.

4. The patient surgery table of claim 3 in which said hip sling contacts said buttocks support.

5. The patient surgery table of claim 1 in which said leg support includes a tibial support and means for vertically adjusting said tibial support relative to said platform.

6. The patient surgery table of claim 1 in which said torso support further includes a torso lift mechanism for moving the torso of a patient vertically relative to said platform.

7. The surgery table of claim 6 in which said transversely movable portion of said platform and said arm support are movable in one direction, and which further comprise means for moving said arm support in another direction.

8. The surgery table of claim 7 in which said means for moving said arm support in another direction moves said arm support in a rotational direction.

9. The surgery table of claim 1 in which said torso support include a pad structure for supporting the patient.

10. The surgery table of claim 1 in which said platform further includes a face pad structure.

11. The surgery table of claim 1 in which said frame includes a first section extending laterally relative to said platform, a second section extending laterally relative to said platform, and a connecting member between said first and second sections of said frame, said connecting member being offset from the centers of said first and second sections.

12. The surgery table of claim 6 in which said torso lift mechanism includes a hydraulic mechanism having a hydraulic cylinder, said hydraulic cylinder being movable transversely with said carriage of said torso support.

13. The surgery table of claim 12 in which said leg support further comprises a hydraulic mechanism, and said torso lift mechanism includes a hydraulic mechanism, said leg support hydraulic mechanism and said torso lift hydraulic mechanism including a common reservoir of hydraulic fluid, a manifold and valve means for controlling the flow of hydraulic fluid to said torso lift and leg support hydraulic mechanism.

14. The surgery table of claim 11 in which said first section of said frame and said second section of said frame includes portions that extend vertically to a greater height than said connecting member.

15. The surgery table of claim 1 which further includes a locking mechanism for arresting movement of said transversely movable portion of said platform and torso support carriage connected thereto.

* * * * *